US007108148B2

(12) United States Patent
Lu

(10) Patent No.: US 7,108,148 B2
(45) Date of Patent: Sep. 19, 2006

(54) DUSTBIN WITH TWO LIDS OPERATED BY A SINGLE PEDAL

(75) Inventor: Jin-Chu Lu, Taipei Hsien (TW)

(73) Assignee: Tieh Chin Kung Metal Industry Co., Ltd., Taipei (TW)

( * ) Notice: Subject to any disclaimer, the term of this patent is extended or adjusted under 35 U.S.C. 154(b) by 227 days.

(21) Appl. No.: 10/790,103

(22) Filed: Mar. 2, 2004

(65) Prior Publication Data

US 2005/0194385 A1 Sep. 8, 2005

(51) Int. Cl.
*B65D 43/26* (2006.01)
*E05F 13/00* (2006.01)

(52) U.S. Cl. ..... 220/263; 220/908; 220/254.9; 220/830; 49/267

(58) Field of Classification Search ..... 220/262–264, 220/254.9, 908, 827, 254.1, 830; 49/267, 49/273, 274, 263
See application file for complete search history.

(56) References Cited

U.S. PATENT DOCUMENTS 6,196,407 B1 * 3/2001 Liu ..... 220/263
6,345,725 B1 * 2/2002 Lin ..... 220/263
6,837,393 B1 * 1/2005 Kuo ..... 220/263

* cited by examiner

*Primary Examiner*—Robin A. Hylton
(74) *Attorney, Agent, or Firm*—Rosenberg, Klein & Lee

(57) ABSTRACT

A dustbin has a main lid pivoted thereto, a second lid slidable on the main lid for covering an opening of the main lid with, a pedal, and a tube having a slide movably confined therein; a first rope is connected to the pedal and the slide while a second rope is connected to the slide and the second lid such that the second lid will be opened immediately after the pedal is depressed; a third rope is connected to the main lid at upper end, and passed through the slide, and has a block connected to the lower end, which is a distance away from the slide before the pedal is depressed; thus, the main lid will be opened by pulling the third rope downwards, and the third rope won't be pulled until the pedal is depressed to such a position that the slide contacts the block to make the block move.

6 Claims, 13 Drawing Sheets

DUSTBIN WITH TWO LIDS OPERATED BY A SINGLE PEDAL

BACKGROUND OF THE INVENTION

1. Field of the Invention

The present invention relates to a pedal dustbin, more particularly one, which has a main lid pivoted to an upper end of the bin body, a second lid capable of sliding on the main lid for covering an opening of the main lid, and a pedal, and which is made such that the second lid will be opened as soon as the pedal is depressed, and the main lid won't be opened unless the pedal is depressed for a longer distance with large force.

2. Brief Description of the Prior Art

Referring to FIG. 13, a conventional pedal dustbin includes a container body 10, a pedal 20, a connecting rod 30, a pushing rod 40, and a lid 50. The lid 50 is pivoted to upper end of the container body 10. The connecting rod 30 is arranged in a lower portion of the container body 10 to function as a lever, and has an outer end projecting out from the container body 10. The pedal 20 is connected to the outer end of the connecting rod 30. The pushing rod 40 is positioned upright close to inner side of the container body 10, and pivoted to an inner end of the connecting rod 30 at a lower end thereof, and pivoted to the lid 50 at an upper end. Thus, the lid 50 will be pivoted upwards to an open position when the pedal 20 is depressed. And, when the user stops depressing the pedal 20, the lid 50 will move back to the closed position automatically due to gravity.

The dustbin is convenient to use because the lid can be opened by means of depressing the pedal. However, such pedal dustbin structure has a disadvantage because a dustbin is equipped with only one lid: people always have to open the lid, which covers the whole opening of the container body, no matter what size of waste they are throwing into the dustbin. And lids of large pedal dustbins can be very heavy in weight because they are large. Consequently, it takes much strength to depress the pedals to open the lids of large pedal dustbins. In other words, large pedal dustbins, and pedal bins with heavy lids are not convenient to use.

Furthermore, plastic pedal dustbins of such structure are prone to have damage caused to them because of improper fitting and use as well as large force that will be exerted on the joint between the pushing rod and the lid, and the joint between the connecting rod and the pushing rod when the pedal is depressed. And, the dustbin can't be repaired when it is damaged.

SUMMARY OF THE INVENTION

It is a main object of the present invention to provide a pedal dustbin to overcome the above disadvantages.

The pedal dustbin of the present invention includes a container body, a main lid pivoted to upper end of the container body, a second lid capable of sliding on the main lid for covering an opening of the main lid with, a pedal, and a holding tube having a slide movably confined therein. A first rope is connected to the pedal and the slide at two ends while a second rope is connected to the slide and the second lid at two ends thereof such that the second lid will be opened immediately after the pedal is depressed. An elastic element is provided for biasing the second lid back to the original position when the user stops depressing the pedal. A third rope is connected to the main lid at upper end, and passed through the slide, and has a stopping block connected to the lower end thereof, which stopping block is a distance away from the slide before the pedal is depressed; thus, the main lid will be opened as soon as the third rope is pulled downwards, and the third rope won't be pulled downwards unless the pedal is depressed to such a position that the slide contacts the block to make the third rope pulled downwards together with it.

The second and the third ropes are passed through respective adjustment mechanisms, which can be adjusted in length. Thus, in case the second and the third ropes are too tight or too loose, the adjustment mechanisms are adjusted in the length such that the lids can be effectively opened when the pedal is used.

BRIEF DESCRIPTION OF THE DRAWINGS

The present invention will be better understood by referring to the accompanying drawings, wherein.

DETAILED DESCRIPTION OF THE PREFERRED EMBODIMENTS

Figure 1:
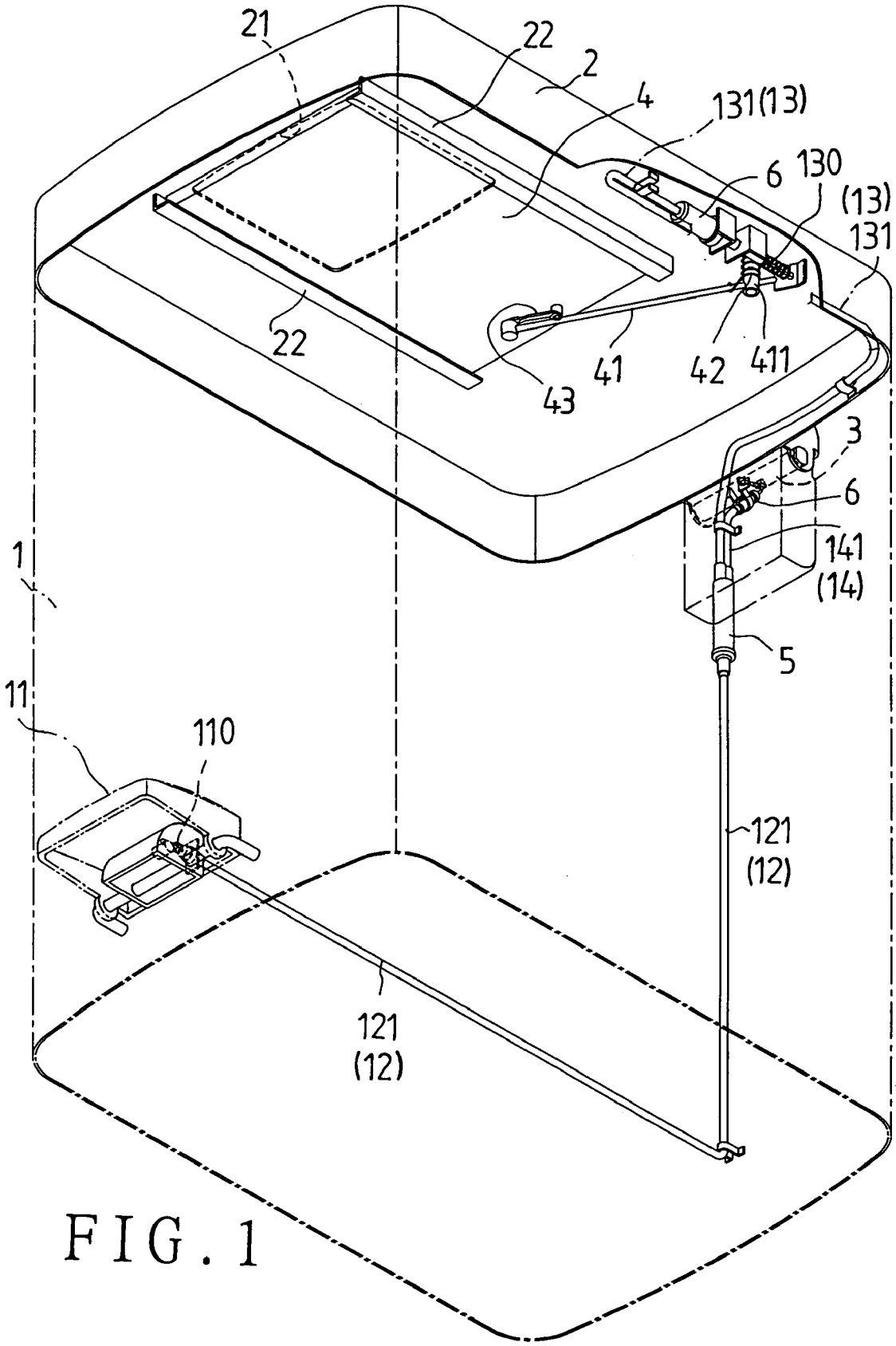
FIG. 1 is a perspective view of the inside of the pedal dustbin with two lids according to the present invention.
Figure 2:
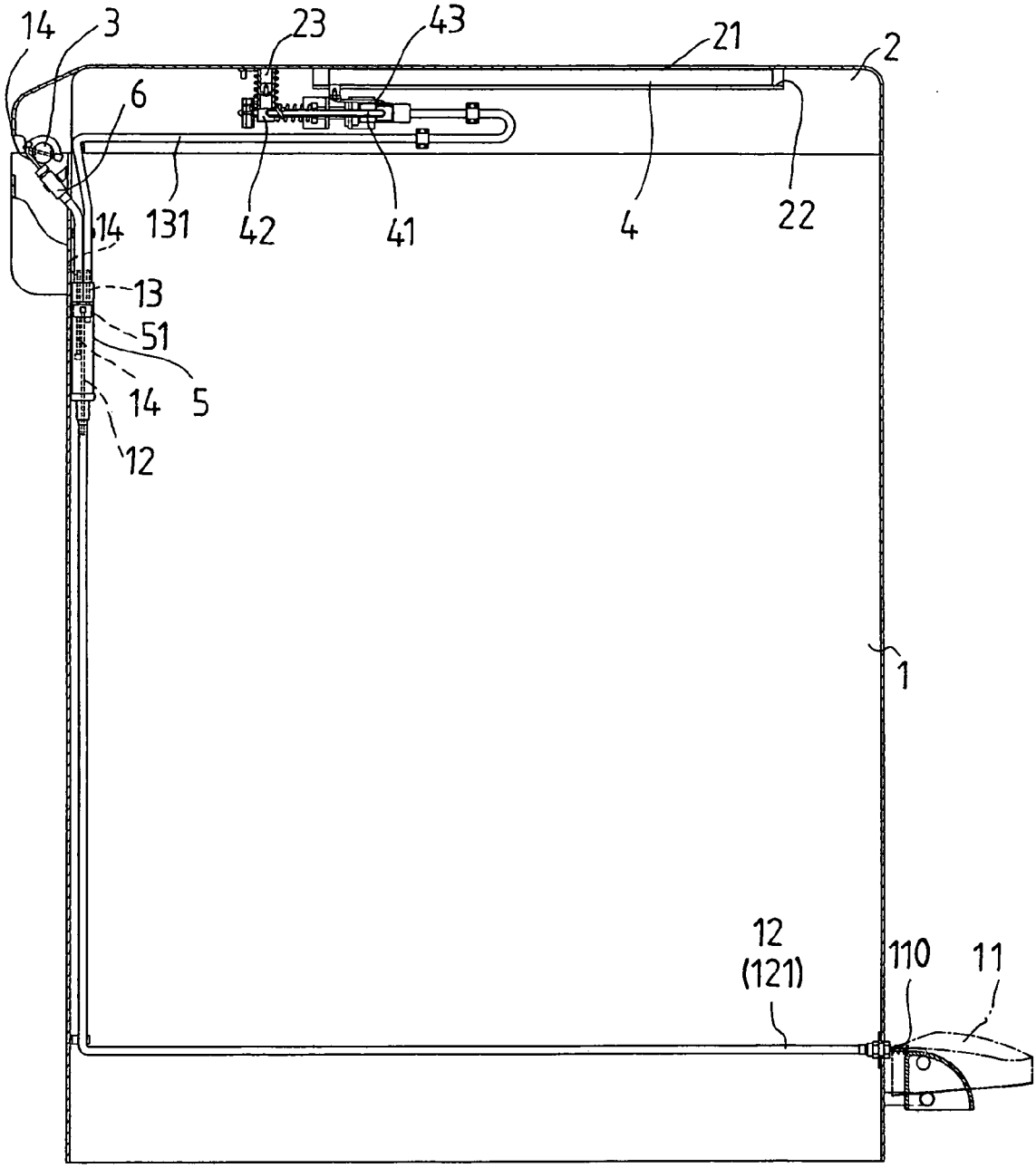
FIG. 2 is a vertical section of the pedal dustbin with two lids according to the present invention.
Figure 3:
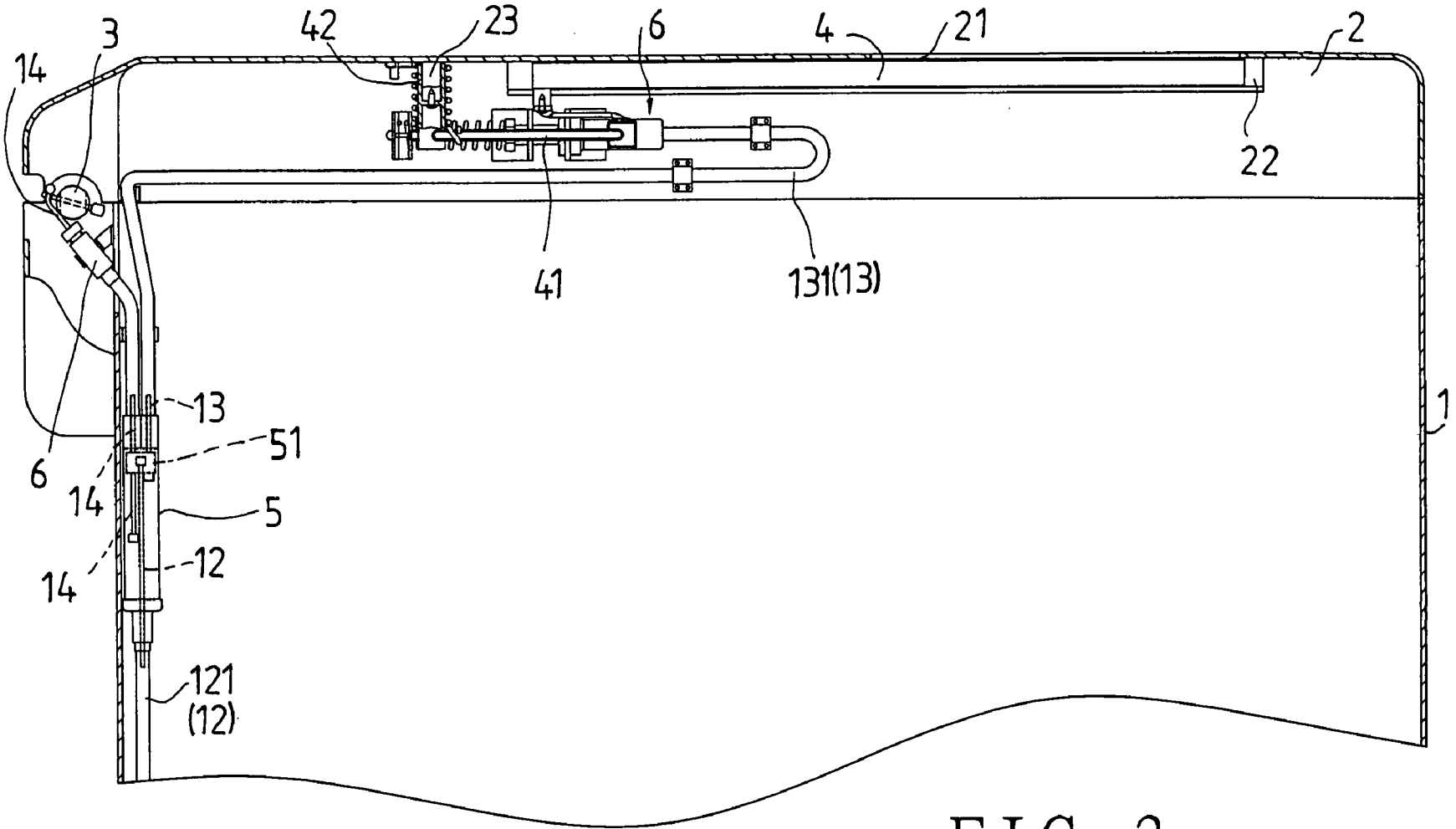
FIG. 3 is a partial enlarged view of FIG. 2.
Figure 4:
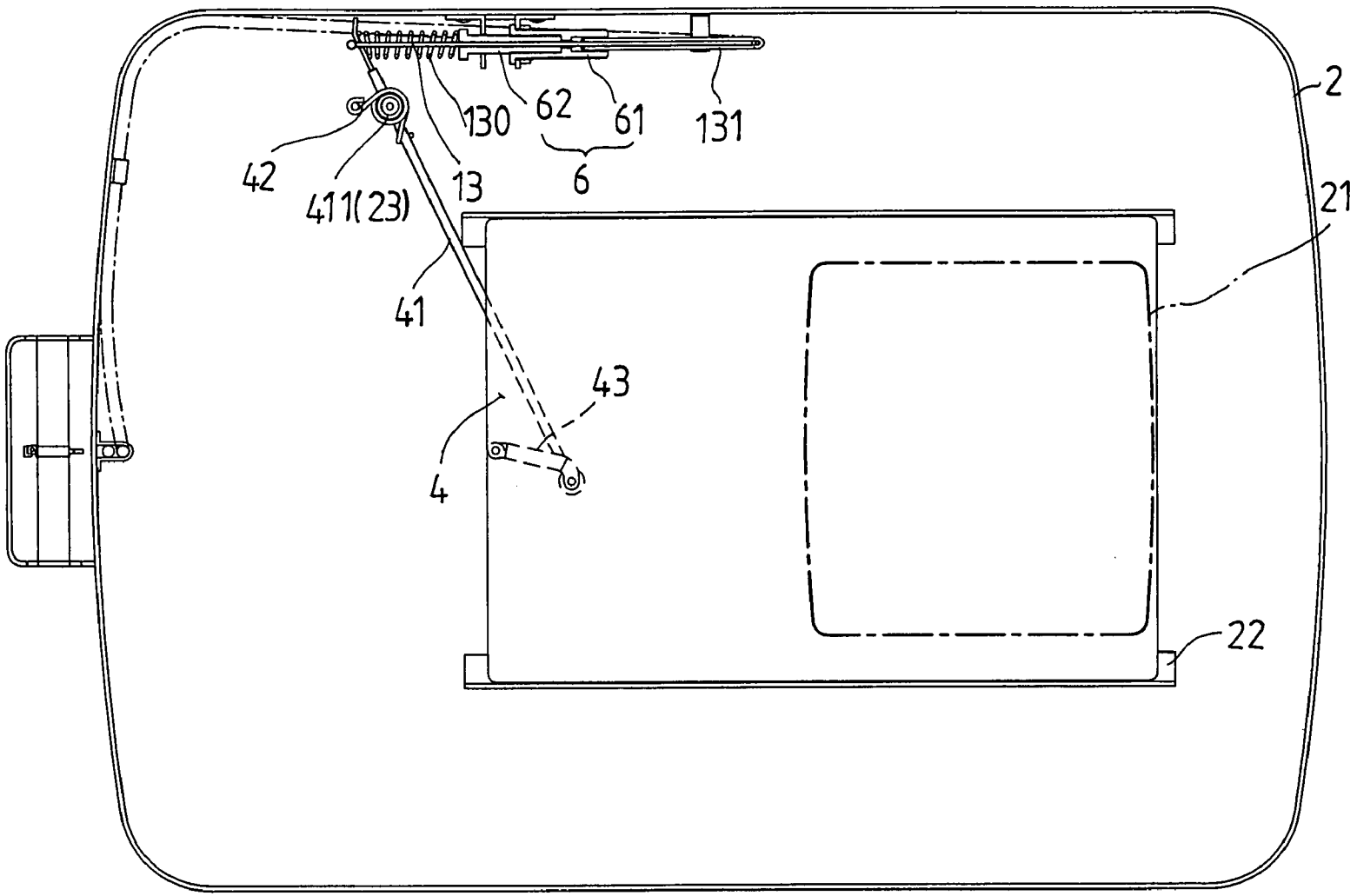
FIG. 4 is a horizontal section of an upper portion of the dustbin.

Referring to FIGS. 1 to 4, a preferred embodiment of a pedal dustbin is shown to include a container part 1, a pedal 11, first, second and third pulling ropes 12, 13 and 14, first and second lids 2 and 4, a holding tube 5, and first and second adjustment mechanisms 6.

The first lid 2 is securely connected to a pivotal rod 3, which is pivoted to a rear edge of an upper end of the container body 1, for covering an upper opening (not numbered) of the container body 1 with. The first lid 2 has an opening 21 thereon, two parallel rails 22, one located on each of two opposite sides of the opening 21, and a post 23 projecting downwards from a lower side thereof. The second lid 4 is movably fitted to the rails 22 of the first lid 2 for covering the opening 21 of the first lid 21 with; thus, the second lid 4 can be opened for allowing waste to be thrown into the container body 1 through the opening 21. A connecting element 43 is pivoted to the second lid 4 at one end.

Each of the adjustment mechanisms 6 includes a fixed part 61, and a stopping part 62; the fixed part 61 has a through hole 611, and an inner threaded portion 612 while the stopping part 62 has a through hole 621, and an outer threaded portion 622; the stopping part 62 is connected to the fixed part 61 with the outer threaded portion 622 being screwed into the inner threaded portion 612, and with the through hole 621 being aligned with the through hole 611. The fixed pant 61 of the first adjustment mechanism 6 is securely fitted on a lower side of the first lid 2 while the fixed part 61 of the second adjustment mechanism 6 is securely fitted on an inner side of the container body 1.

An actuating rod 41 is pivoted to the post 23 of the first lid 2 at a portion between first and second ends thereof. An elastic element 42 is positioned around the post 23, and connected to the actuating rod 41 and the first lid 2 at two ends; thus, the elastic element 42 will bias the actuating rod 41 back to an original position when an external force disappears that has been exerted on the actuating rod 41 to angularly displace the same. The actuating rod 41 is pivoted to the other end of the connecting element 43 at the first end thereof while an elastic element 130 is positioned between the second end of the actuating rod 41 and the stopping part 62 of the first adjustment mechanism 6; thus, the elastic element 130 will help bias the actuating rod 41 back to the original position when an external force disappears that has been exerted on the actuating rod 41 to angularly displace the same; the second lid 4 will be over the opening 21 of the first lid 2 when the actuating rod 41 is moved to the original position owing to the connection of the actuating rod 41 with the connecting element 43.

Figure 5:
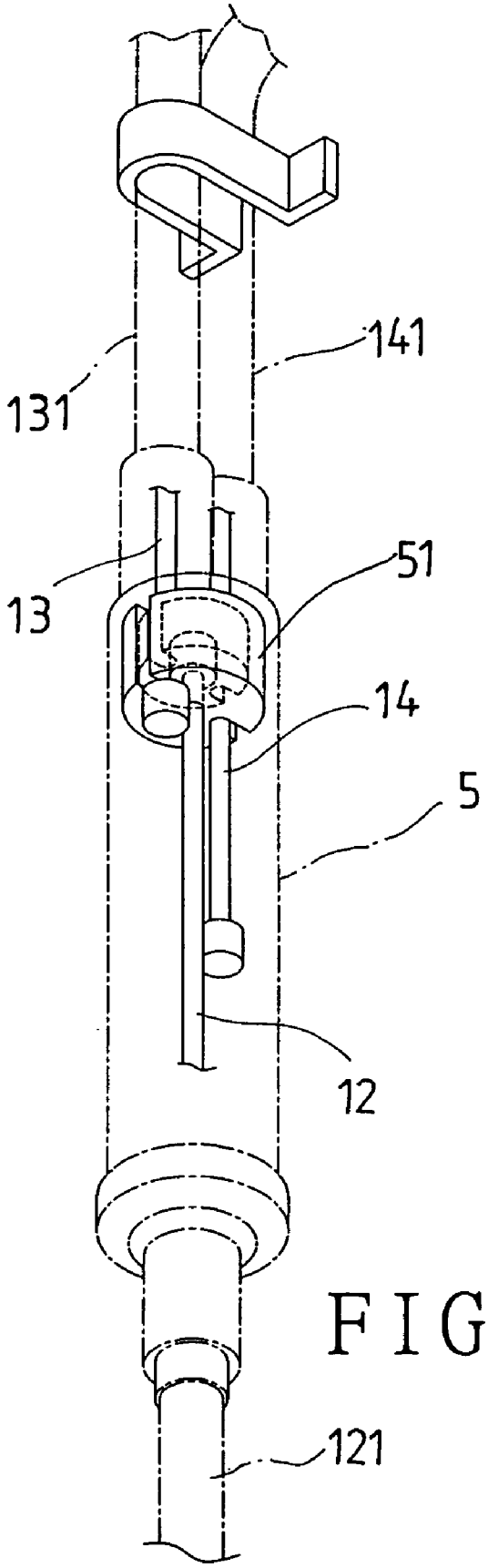
FIG. 5 is a perspective view of the inside of the holding tube of the pedal dustbin in the present invention.
Figure 6:
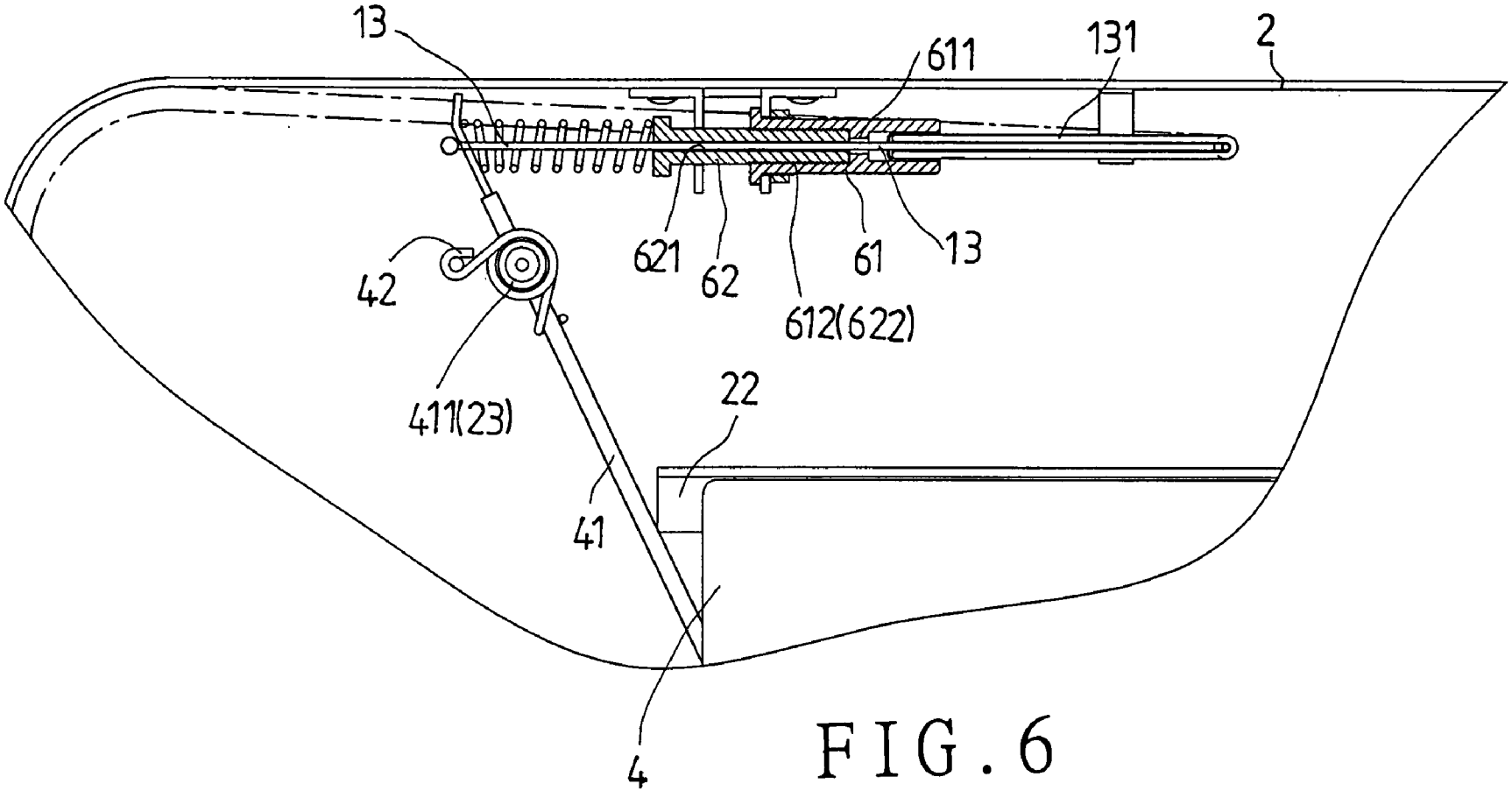
FIG. 6 is a horizontal section of an upper portion of the dustbin.
Figure 7:
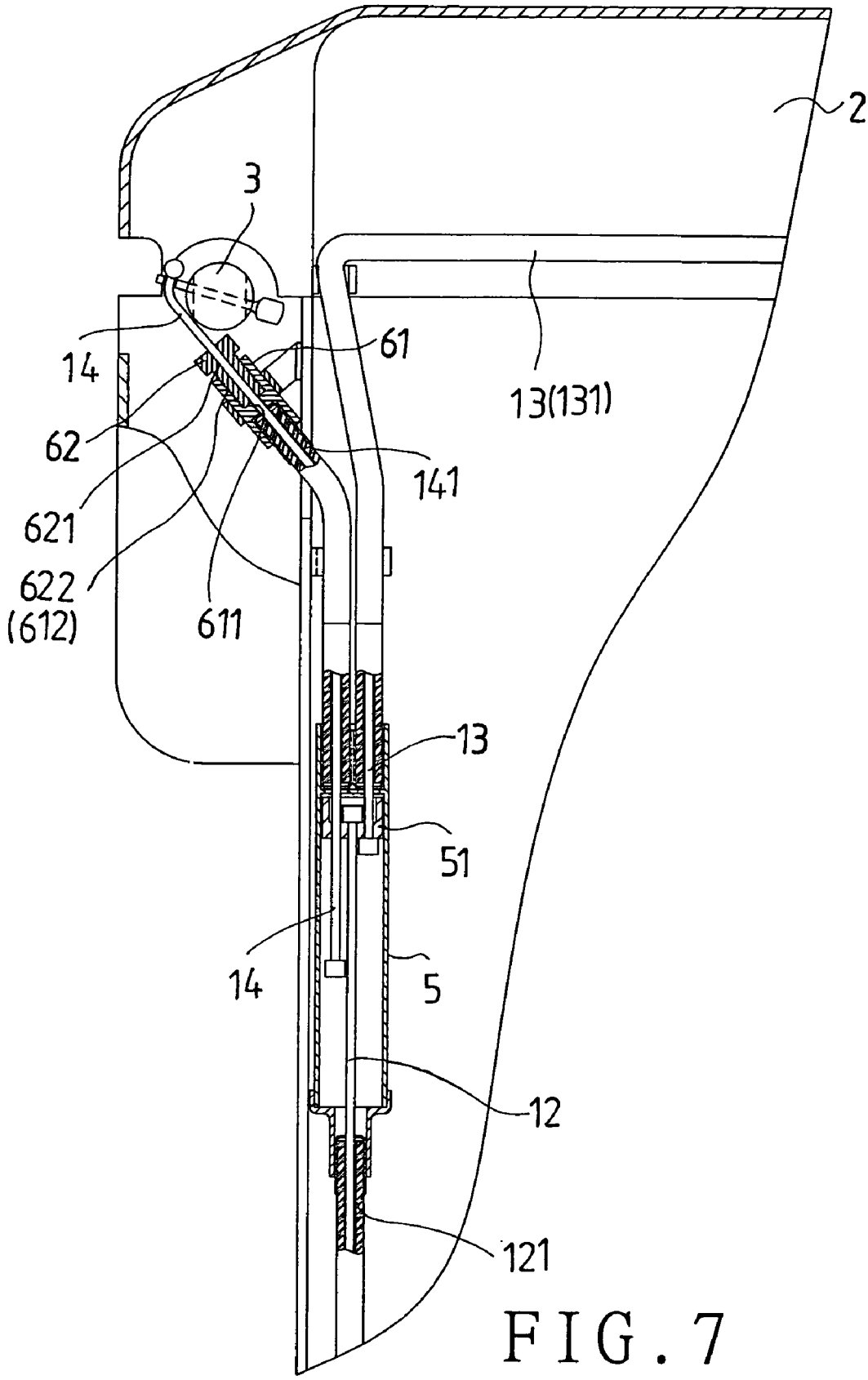
FIG. 7 is a partial vertical section of the present dustbin.

The holding tube 5 is securely fitted on the inner side of the container body 1 under the fixed part 61 of the second adjustment mechanism 6. Referring to FIG. 5, the holding tube 5 has openings (not numbered) at upper and lower ends, and has a slide 51 confined therein, which can move along the holding tube 5. A third covering body 141 is securely connected to the upper end of the holding tube 5 and the fixed part 61 of the second adjustment mechanism 6 at two ends so as to communicate with inside of the holding tube 5 a well as the through holes 611 and 621 of the second adjustment mechanism 6. And, a second a covering body 131 is securely connected to the upper end of the holding tube 5 and the fixed part 61 of the first adjustment mechanism 6 at two ends so as to communicate with inside of the holding tube 5 a well as the through holes 611 and 621 of the first adjustment mechanism 6. A first covering body 121 is securely connected to the container body 1 and the lower end of the holding tube 5.

The pedal 11 is pivoted to a front of a lower portion of the container body 1, and is biased upwards to a not-depressed position by means of an elastic element 110, which is connected to the pedal 11 at one end, and the container body 1 at the other end. The first pulling rope 12 is passed through the first covering body 121 as well as the lower opening of the holding tube 5, and is connected to the pedal 11 at a lower end, and the slide 51 at an upper end; thus, the first pulling rope 12 will be pulled, and the slide 51 moved downwards when the pedal 11 is depressed.

Figure 8:
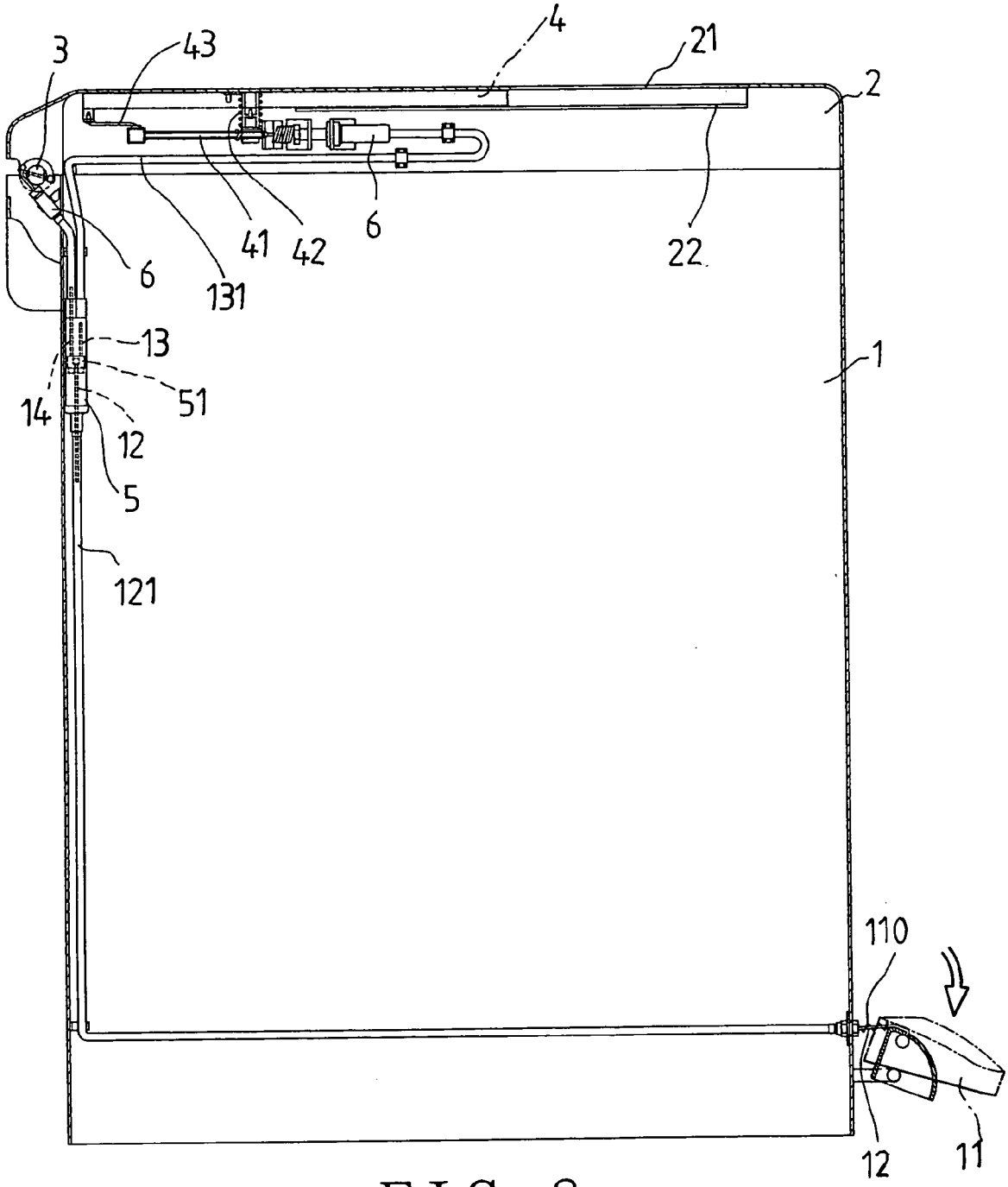
FIG. 8 is a vertical section of the present dustbin with the pedal being depressed so as to open the second lid.
Figure 10:
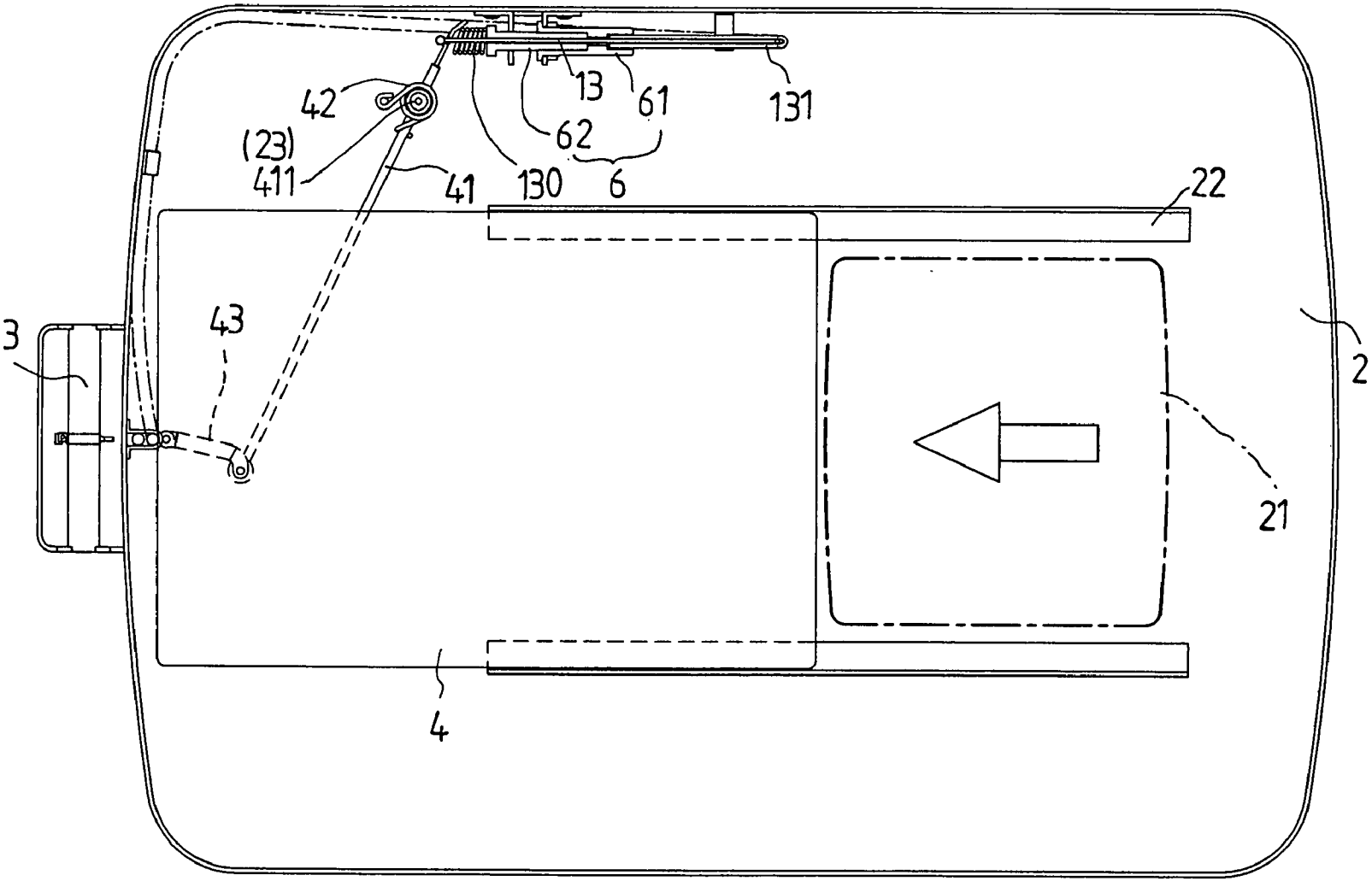
FIG. 10 is a top view of the dustbin, showing the movement of the second lid and the associated parts when the pedal is depressed.

The second pulling rope 13 is passed through the second covering body 131 as well as the through holes 611 and 621 of the first adjustment mechanism 6, connected to the slide 51 at a lower end, and connected to the second end of the actuating rod 41 at an upper end thereof; thus, the elastic element 130, which is positioned between the second end of the actuating rod 41 and the stopping part 62 of the first adjustment mechanism 6, will be compressed, and the second lid 4 will be opened immediately after the pedal 11 is depressed, as shown in FIGS. 8 and 10.

The third pulling rope 14 is passed through the through holes 611 and 621 of the second adjustment mechanism 6, the third covering body 141, the upper opening of the holding tube 5, and the slide 51. A stopping block 140 is securely connected to a lower end of the third pulling rope 14. The third pulling rope 14 is further connected to the pivotal rod 3 at an upper end thereof such that the pivotal rod 3 will be angularly displaced, and the first lid 2 opened when the third pulling rope 14 is pulled downwards. The stopping block 140 will be a distance away from the slide 51 when the pedal 11 is not used, i.e. when the lids 2 and 4 are in the closed position; thus, the third pulling rope 14 will not be pulled downwards during depression movement of the pedal 11 until the pedal 11 is depressed to such a position (FIGS. 11 and 12) that the slide 51 comes into contact with the stopping block 140 to make the stopping block 140 move downwards together with it.

Furthermore, an elastic element (not shown) can be engaged with the pivotal rod 3 and the second adjustment mechanism 6 at two ends thereof.

Figure 9:
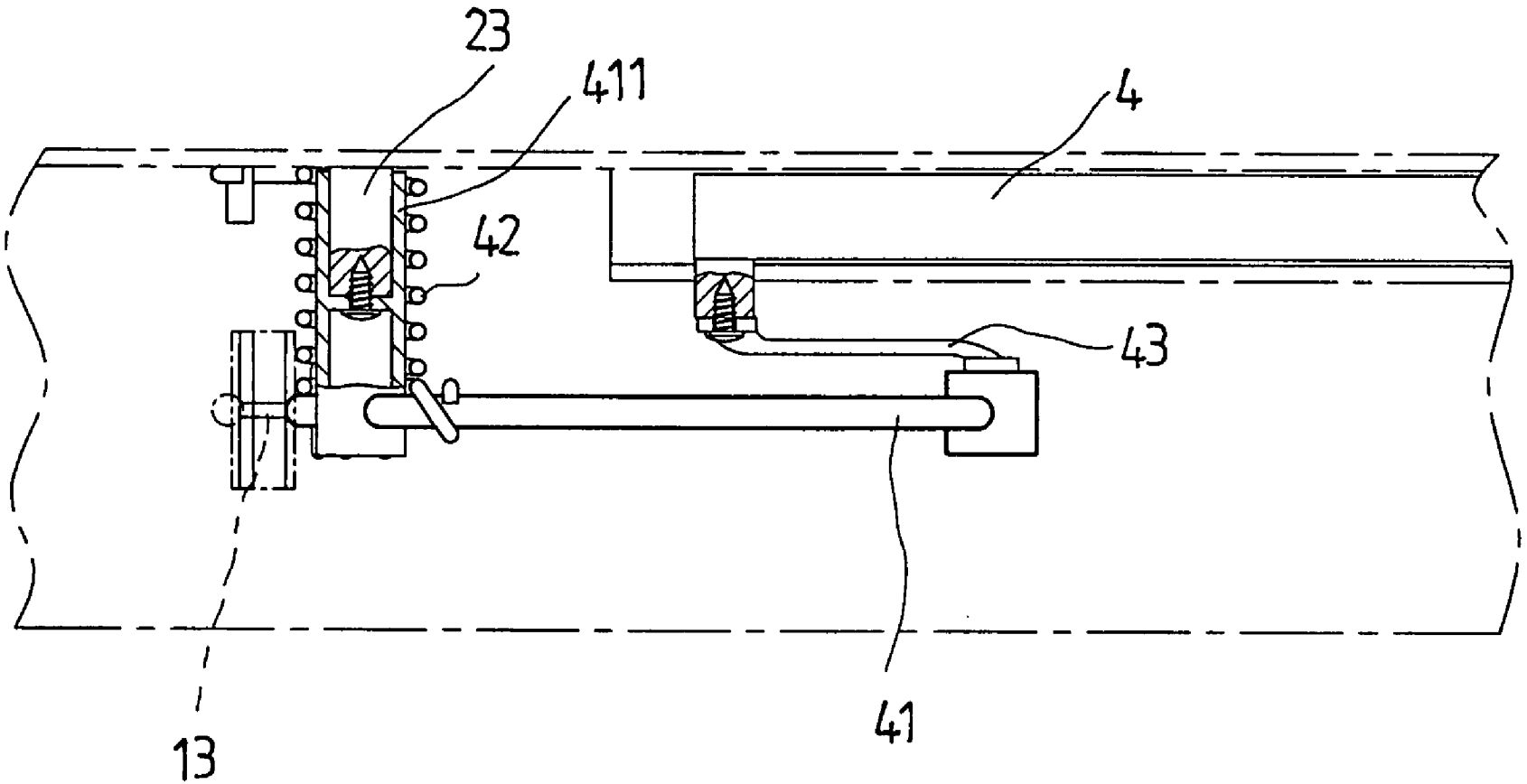
FIG. 9 is a partial side view of the dustbin, showing the movement of the second lid and the associated parts when the pedal is depressed.

To open the second lid 4 for allowing small waste to be thrown into the container body 1 through the opening 21 of the first lid 2 without opening the first lid 2, referring to FIGS. 8 to 10, the pedal 11 is depressed with small force for such a distance that the second pulling rope 13 and the slide 51 are pulled downwards by the first pulling rope 12, and such that the stopping block 140 of the third rope 14 isn't moved down by the slide 51; thus, the second lid 4 is slid along the rails 22 and opened while the first lid 2 isn't moved. As soon as the user stops depressing the pedal 11, the elastic elements 130 and 42 will make the actuating rod 41 move back to the original position; thus, the second lid 4 is closed.

Figure 11:
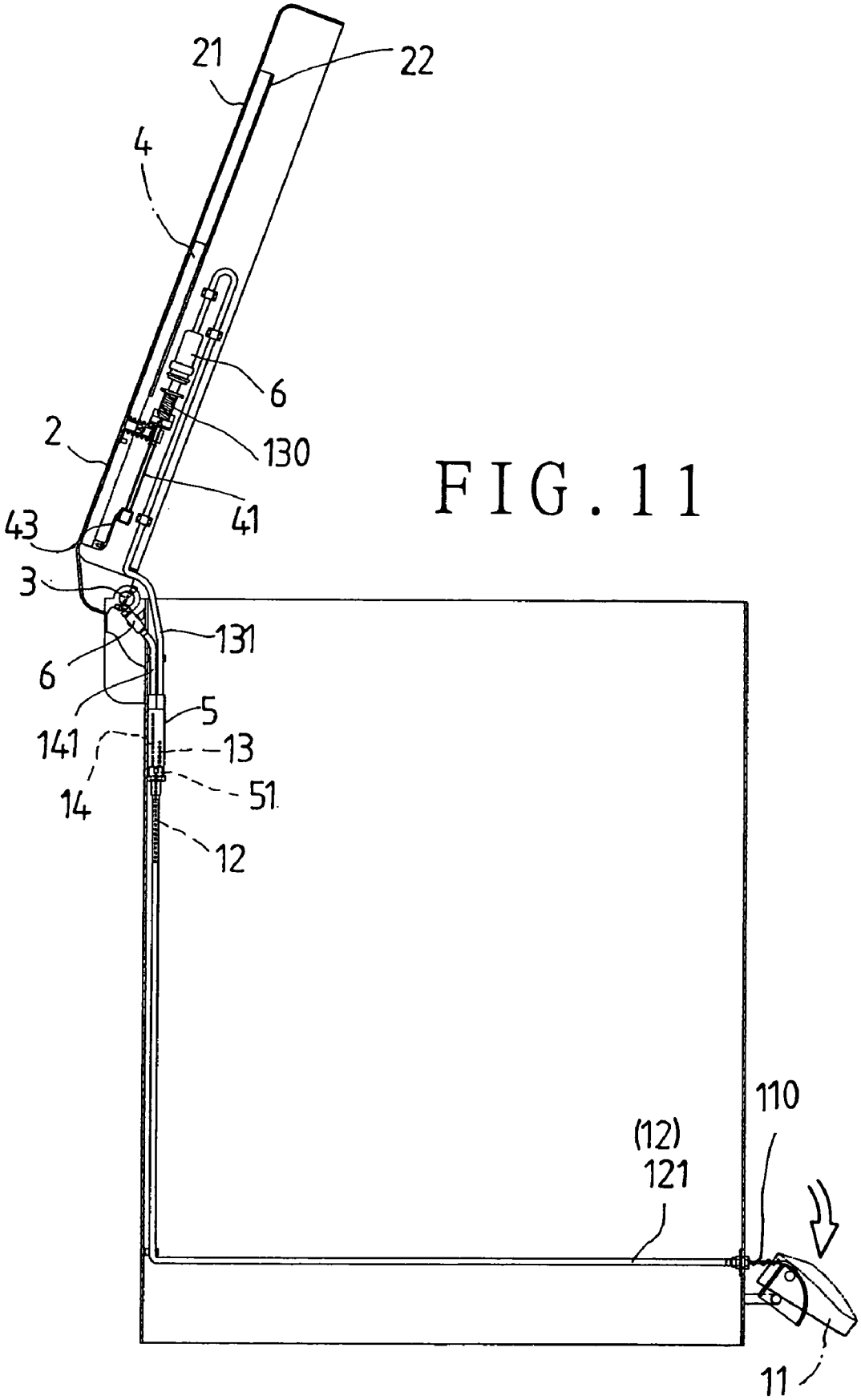
FIG. 11 is a side view of the dustbin with the first lid being opened.
Figure 12:
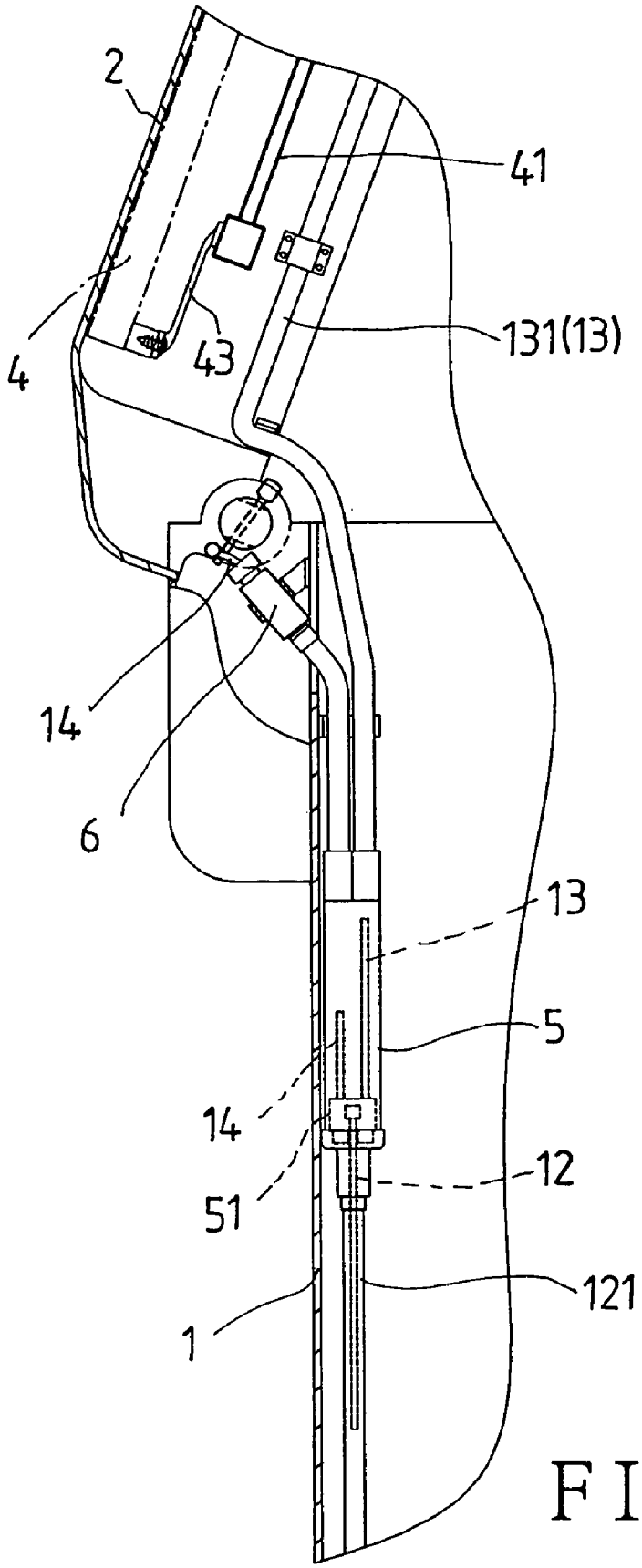
FIG. 12 is a partial enlarged view of FIG. 11.
Figure 13:
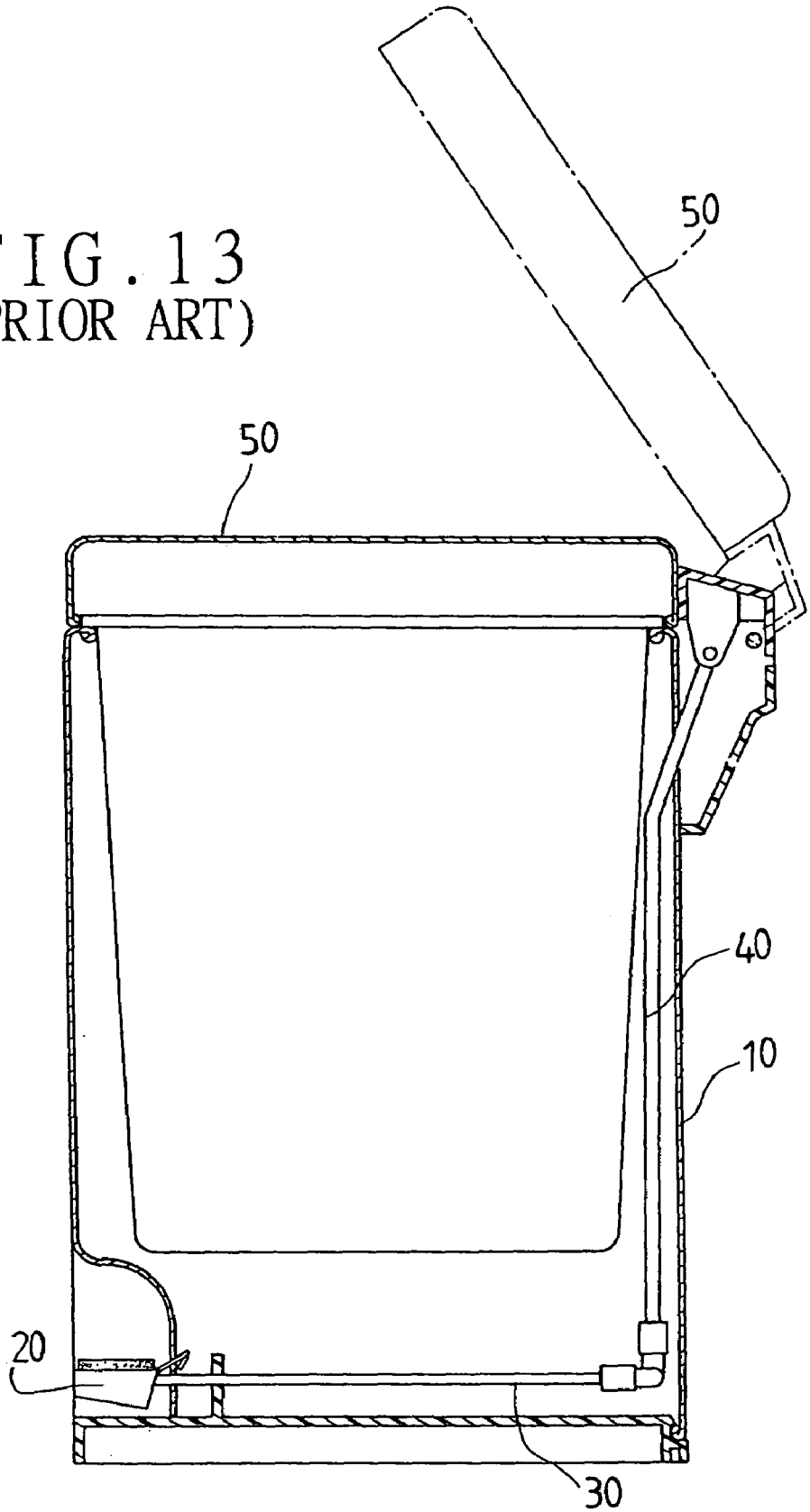
FIG. 13 (PRIOR ART)
FIG. 13 is a side view of the conventional pedal dustbin.

To open the first lid 2 for allowing large waste to be thrown into the container body 1 through an upper opening of the container body 1, referring to FIGS. 11 and 12, the pedal 11 is depressed for a longer distance with large force such that besides pulling the second pulling rope 13 and the slide 51 downwards, the first pulling rope 12 makes the slide 51 pull the third pulling rope 14 downwards; thus, the pivotal rod 3 is turned, and the first lid 2 opened. As soon as the user stops depressing the pedal 11, the first lid 4 will move back to the closed position automatically owing to gravity.

The length of the first adjustment mechanism 6 is adjusted by means of angularly displacing the stopping part 62 relative to the fixed part 61 in case the second pulling rope 13 is too tight or too loose; thus, the second lid 4 can be effectively and properly opened when the pedal 11 is depressed for a short distance. And, the length of the second adjustment mechanism 6 is adjusted by means of angularly displacing the stopping part 62 relative to the fixed part 61 in case the third pulling rope 14 is too tight or too loose; thus, the first lid 2 can be effectively and properly opened when the pedal 11 is depressed for said longer distance.

From the above description, it can be easily understood that the present pedal dustbin with two lids has the following advantages:

1. The dustbin is simple in the structure, and easy to assemble. Furthermore, being equipped with ropes as the transmission, the dustbin is less likely to have damage caused to it when the pedal 11 is being depressed to open the lids.
2. People only have to depress the pedal 11 to open the second lid 4 with small force in case they want to throw small waste into the dustbin; people have to depress the pedal 11 so as to open the first lid 2, which is larger and heavier than the second lid 4, only when they want to throw large waste into the dustbin. In other words, being equipped with the second lid 4, the dustbin allows people to save their strength.

What is claimed is:

1. A pedal dustbin with two lids, comprising a container body for holding waste therein;

a pedal pivotally connected to a lower portion of the container body;

a pivotal rod pivotally connected to a rear edge of an upper end of the container body;

a first lid securely connected to the pivotal rod for covering an upper opening of the container body, the first lid having an opening formed therein, and two parallel rails, one located on each of two opposing sides of the opening; the first lid having a post projecting downwards from a lower side of the first lid;

a second lid linearly displaceably fitted to the rails of the first lid for covering the opening of the first lid;

an actuating rod pivoted to the post of the first lid at a portion between first and second ends of the actuating rod;

a connecting element pivoted to the second lid and the first end of the actuating rod at two respective ends of the connecting element such that angular displacement of the actuating rod will cause linear movement of the second lid along the rails of the first lid;

a first elastic element positioned around the post and having opposing ends respectively secured to the actuating rod and the first lid for biasing the actuating rod back to an original position when an external force that has been exerted on the actuating rod to angularly displace the actuating rod has been removed, the second lid being over the opening of the first lid when the actuating rod is in the original position;

a holding tube securely fitted on the container body, the holding tube having openings at upper and lower ends thereof;

a slide confined in, and movable along the holding tube;

a first covering body having one end securely connected to the container body and an opposing end connected to the lower end of the holding tube a first pulling rope passed through both the covering body and the lower opening of the holding tube, the first pulling rope having a lower end connected to the pedal and an upper end connected to the slide such that the first pulling rope will be pulled, and the slide moved downwards when the pedal is depressed;

a second covering body having a first end securely connected to the upper end of the holding tube, the second covering body having a second end;

a second pulling rope passed through the second covering body and the upper opening of the holding tube, the second pulling rope having a lower end connected to the slide and an upper end of the second pulling rope being connected to the second end of the actuating rod such that the second lid will be opened as soon as the pedal is depressed;

a third covering body having one end securely connected to the upper end of the holding tube and an opposing end secured to the container body;

a third pulling rope passed through the third covering body, the upper opening of the holding tube, and the slides, the third pulling rope having a lower end securely connected to a stopping block under the slide and an upper end connected to the pivotal rod such that the pivotal rod will be angularly displaced and the first lid opened when the third pulling rope is pulled downwards, the stopping block being disposed at a distance away from the slide when there is no external force being exerted to depress the pedal, the first lid being opened responsive to the pedal being depressed to a position where the slide comes into contact with the stopping block for allowing both the stopping block and the third pulling rope to be pulled downwards together with the slide.

2. The pedal dustbin as claimed in claim 1, wherein an adjustment mechanism is fitted on the first lid, and the second pulling rope is passed through the adjustment mechanism after having been passed through the second covering body; the adjustment mechanism including:

a fixed part having a through hole for the second pulling rope to be passed therethrough, and an inner threaded portion, the fixed part being securely connected to the second end of the second covering body; and a stopping part having a through hole for the second pulling rope to be passed therethrough, and an outer threaded portion, the stopping part being connected to the fixed part with the outer threaded portion being connected to the inner threaded portion, and with the through holes being aligned with each other;

thereby the adjustment mechanism being adjustable in length for accommodating a length of the second pulling rope by means of angularly displacing the stopping part relative to the fixed part.

3. The pedal dustbin as claimed in claim 2, wherein a second elastic element is positioned between the stopping part of the adjustment mechanism and the upper end of the second pulling rope.

4. The pedal dustbin as claimed in claim 1, wherein an adjustment mechanism is fitted on the container body, and the third pulling rope is passed through the adjustment mechanism after having been passed through the third covering body; the adjustment mechanism including:

a fixed part having a through hole for the third pulling rope to be passed therethrough, and an inner threaded portion, the fixed part being securely connected to the opposing end of the third covering body; and a stopping part having a through hole for the third pulling rope to be passed therethrough, and an outer threaded portion, the stopping part being connected to the fixed part with the outer threaded portion being connected to the inner threaded portion, and with the through holes being aligned with each other;

thereby the adjustment mechanism being adjustable in length for accommodating a length of the third pulling rope by means of angularly displacing the stopping part relative to the fixed part.

5. The pedal dustbin as claimed in claim 4, wherein a third elastic element has two ends respectively engaged with the adjustment mechanism and the pivotal rod.

6. The pedal dustbin as claimed in claim 1, wherein an elastic element has two ends respectively connected to the pedal and the container body.

* * * * *